US005842507A

United States Patent [19]

Fellman et al.

[11] Patent Number: 5,842,507

[45] Date of Patent: Dec. 1, 1998

[54] WOOD CHIP OPTIMIZER

[75] Inventors: Hannu Antero Fellman, Rauma; Sean Walsh, Vantaa, both of Finland

[73] Assignee: BMH Wood Technology Oy, Rauma, Finland

[21] Appl. No.: 806,036

[22] Filed: Feb. 7, 1997

[30] Foreign Application Priority Data

Feb. 12, 1996 [FI] Finland ..... U960093

[51] Int. Cl.[6] ..... B27M 1/02; B27B 9/20

[52] U.S. Cl. ..... 144/364; 100/176; 241/24.29; 241/28; 241/235; 144/2.1

[58] Field of Search ..... 144/2.1, 329, 361, 144/362, 162.1, 174; 100/121, 176, 902; 241/24.29, 28, 159, 235

[56] References Cited

U.S. PATENT DOCUMENTS

| | | | |
|---|---|---|---|
| 3,438 | 2/1844 | Battin . | |
| 1,329,973 | 2/1920 | Jardine | 241/235 |
| 1,980,193 | 2/1934 | Finegan | 83/75 |
| 3,070,318 | 12/1962 | Blanchard | 241/14 |
| 3,387,795 | 6/1968 | Bidwell | 241/34 |
| 3,393,634 | 7/1968 | Blackford | 100/39 |
| 3,406,624 | 10/1968 | Kutchera et al. | 100/170 |
| 3,981,453 | 9/1976 | Berlyn et al. | 241/21 |
| 4,050,980 | 9/1977 | Schmidt et al. | 162/24 |
| 4,235,382 | 11/1980 | Smith | 241/28 |
| 4,616,785 | 10/1986 | Artiano | 241/26 |
| 4,718,338 | 1/1988 | Koba | 144/362 |
| 4,723,718 | 2/1988 | LaPointe | 241/235 |
| 4,790,360 | 12/1988 | Clarke et al. | 144/213 |
| 4,850,404 | 7/1989 | Koba | 144/2 R |
| 4,903,845 | 2/1990 | Artiano | 209/671 |
| 4,953,795 | 9/1990 | Bielagus | 241/159 |
| 5,161,591 | 11/1992 | Sealey et al. | 144/362 |
| 5,179,986 | 1/1993 | Beuving et al. | 144/362 |
| 5,199,476 | 4/1993 | Hoden | 144/362 |
| 5,234,040 | 8/1993 | Koba | 144/2 R |
| 5,385,309 | 1/1995 | Bielagus | 241/235 |
| 5,505,238 | 4/1996 | Fujii et al. | 144/362 |
| 5,533,684 | 7/1996 | Bielagus | 144/362 |

FOREIGN PATENT DOCUMENTS

| | | |
|---|---|---|
| 0825416 | 10/1969 | Canada . |
| 0839549 | 4/1970 | Canada . |
| 0328067 | 8/1989 | European Pat. Off. . |
| 2113572 | 5/1972 | France . |
| 2333727 | 2/1975 | Germany . |
| 1037946 | 8/1983 | U.S.S.R. . |
| 0261753 | 12/1927 | United Kingdom . |
| 0406262 | 5/1932 | United Kingdom . |

*Primary Examiner*—W. Donald Bray
*Attorney, Agent, or Firm*—Needle & Rosenberg, P.C.

[57] ABSTRACT

A wood chip conditioner that uses at least two closely spaced, counter-rotating rolls having a regular, wave shaped profile formed into their surfaces having a repeating pattern of peaks and valleys that radially circumscribes the roll and which are preferably the same dimension and offset from each other so that a peak on one roll is in registry with a valley on the other roll and form a nip through which oversized wood chips traverse. The chips passing through the nip are destructured by being bent and compressed by the surfaces on the rolls, which produces internal cracks along the grain of the wood without penetrating the chips. The rolls are also designed to avoid breaking or fracturing the chips, which would increase the occurrence of undesirable pins and fines. The surface of the peaks preferably also have shallow, equally-spaced grooves that extend axially. The grooves provide an edge that catches and pulls the chips into and through the nip. The bending action to which the chips traversing through the nip are subjected also loosens or dislodges the bark on the outer surface of the chips by breaking the bond between the bark and the chip. The present invention also includes a method of using the wood chip conditioner to destructure and remove moisture from fuel chips.

20 Claims, 3 Drawing Sheets

WOOD CHIP OPTIMIZER

BACKGROUND OF THE INVENTION

1. Field of the Invention

The present invention relates to an apparatus and method for treating wood chips to enhance their properties for subsequent processing operations, such as pulping and debarking. In particular, the present invention relates to a device that treats oversized wood chips by bending and compressing them so that internal cracks are formed within the chips along the grain, which assists in the absorption of digesting chemicals.

2. Background Art

Wood fiber is the basic ingredient used in paper production. Although other types of fibers may also be used, more than half the fiber used to manufacture paper comes from trees that are cut specifically for the production of pulp. The wood fibers must be freed from the raw wood. The trees, accordingly, are cut into logs that are reduced to pulp either by being mechanically ground or by being debarked, chipped, and cooked in a chemical solution. Chemically digested wood chips generally result in a higher-quality paper than mechanically ground pulp.

Two common processes are used to chemically reduce wood chips into pulp: the sulfite process, and the sulfate, or kraft, process. In both of these processes, lignin is dissolved under heat and pressure in a digester, resulting in the separation of cellulose fibers. Processing time may be as long as twelve hours, depending upon the size of the chips and the quality of the product desired. Processing chemicals, particles of undigested wood, and foreign materials are removed, and the pulp is further processed into paper.

The amount of processing time required depends on the thickness of the wood chips used. Thicker wood chips require a longer time for the processing chemicals to penetrate and dissolve their lignin. To ensure uniform processing time and paper quality, wood chips are sized before they are processed, with thicker wood chips being removed prior to pulping.

A wood chip screening device is often used to sort the wood chips after leaving the chipper. The screen has openings through which only chips smaller than a preselected thickness may pass. The screening device agitates the chips, causing essentially all of the thinner chips to pass through the screen, called the "accepts." The thinner chips are then chemically processed.

There are difference uses for the overthick chips that do not pass through the screening device, called "overs." One option is to re-process the overthick chips through a slicer to reduce their thickness. A slicer, however, has the undesirable effect of creating excessive fines and pins, which reduces the overall yield of high quality fibers from a given quantity of raw wood. Since raw wood is a major contributor to the cost of the paper produced, re-slicing can cause a considerable economic expense.

An alternative to re-slicing overthick wood chips is a process known as "destructuring" the chips. Advantages of destructuring chips include low operating and maintenance costs compared with using a chipper. Destructuring chips also reduces the amount of pins and fines generated.

In a destructuring device, the chips are fed through opposed rollers forming a nip which compresses the chips as they pass through it. The compression of the chip results in fractures in the wood chips. The fractures, or cracks, allow the cooking liquor to penetrate into the interior of the chip, thus achieving the same effect as reducing the chip's thickness. However, cracking across the grain of the chip, as opposed to longitudinally along the grain, damages the fibers and thus produces a paper with lower strength characteristics. It is, therefore, desirable to form internal longitudinal cracks in the chips, without cracking the exterior surface of the chips.

The prior art destructuring devices have drawbacks. Some machines use a pair of rolls that fail to cause adequate bending in the chips. These machines predominantly compress the chips. Also, since these machines do not sufficiently bend the chips, they do not adequately form fissures or cracks in the chips. Cracks that do form may be in any direction, depending on the chip orientation as it passes through the nip. Examples of these types of machines are shown in U.S. Pat. Nos. 4,723,718, issued to LaPointe, and 3,406,624, issued to Kutchera et al.

Other machines cause more bending, but also cause some breaking of the chips so that excessive pins and fines are produced. The more pins and fines that are produced, the more significant the waste and economic loss. An example of such a machine is shown in U.S. Pat. Nos. 4,953,795 and 5,385,309, both issued to Bielagus and assigned to Beloit Corporation. The roll surfaces of both devices consist of a plurality of intemested truncated pyramids, which can cause cross-grain cracking and fiber damage. It is desired, therefore, to have a roll surface that bends and compresses the chips, but will not cause fiber damage or create excessive pins and fines.

In another method of chip treatment, known as the "Massahake" method, whole tree chips are produced and sorted for use, either for pulp production or as wood fuel. It is common for chips to have some bark still attached after chipping. The presence of bark on pulp chips is detrimental to the pulp quality and, thus, these chips must be removed for use as fuel or otherwise discarded.

As one skilled in the art appreciates, a large difference exists in the monetary value of pulp chips and fuel chips. Since pulp chips cost more than fuel chips, it is desirable to remove the bark from the chips so that they can be used for pulp production, rather than as fuel. One common method of removing the bark is to use grinders. Grinders, however, produce large amounts of pins and fines, thereby lowering the overall yield. Thus, it is desired to use a method of removing bark from wood chips without producing excessive amounts of pins and fines. Furthermore, for any chips that are used as fuel, it is desired to treat the chips to increase the energy generation.

SUMMARY OF THE INVENTION

The above needs in the art are satisfied by the present invention, which comprises a wood chip conditioner, also known as a wood chip optimizer. The wood chip conditioner uses at least two closely spaced, counter-rotating rolls having a regular, wave shaped profile formed into their surfaces, e.g., a profiled roll surface. The opposed rolls form a nip through which oversized wood chips traverse. The chips passing through the nip are destructured by being bent and compressed by the surfaces on the rolls, which produces internal cracks along the grain of the wood.

The destructured chips are then used to make paper because the internal cracks increase cooking liquor penetration. The overthick chips would otherwise have to be re-sliced to the correct thickness, used for purposes other than to make paper such as fuel, or discarded.

The surface of each roll is wavy and forms a flute profile having a repeating pattern of peaks and valleys that radially circumscribes the roll. The peaks and valleys on each roll are preferably the same dimension and offset from each other so that a peak on one roll is in registry with a valley on the other roll. This internested peak-to-valley pattern causes the chips to bend as they pass through the nip of the rolls. The bending causes internal cracking and fissures in the chips, thus exposing more fibers and increasing the surface area. The chips are also compressed when passing through the nip, which assists in the destructuring process. However, the smooth, continuously curving roll surface does not penetrate the chips, thereby minimizing the breaking or fracturing of the chips, which would increase the occurrence of undesirable pins and fines.

The surface of the peaks preferably have shallow, equally-spaced grooves that extend axially, or substantially parallel to the longitudinal axis of the rolls. The grooves provide an edge that catches and pulls the chips into and through the nip.

In the preferred embodiment, the two horizontally-disposed, counter-rotating rolls are mounted on a frame. The axis about which the first of the rolls rotates is stationarily mounted to the frame and the axis about which the second roll rotates is disposed on pivoting arms. The pivoting arms laterally move the second roll relative to the stationarily-mounted first roll using low-pressure hydraulic cylinders. The relative lateral movement adjusts the nip for different chip thicknesses.

During operation of the wood chip conditioner, the only components of the apparatus that come into contact with the wood chips are the profiled roll surfaces. These roll surfaces are subject to wear and occasional damage. Despite the precautions taken, it is possible for pieces of tramp metal or other non-compressible articles in the wood chip flow to pass into and through the nip. The roll surface is, therefore, preferably constructed from interchangeable segments detachably connected to an inner shell. This allows the outer surface to be easily serviceable with the minimum labor requirements and downtime. The segmental design also advantageously allows individually damaged segments to be removed and replaced, rather than replacing the whole roll surface.

Yet another advantage of the present invention is that it can be used to release or dislodge bark from the surface of wood chips. The bending action to which the chips traversing through the nip are subjected loosens the bark by breaking the bond between the bark and the chip. If the bark is not completely freed, subsequent light physical action will complete the task. In contrast, prior art destructuring devices cannot effectively perform this function.

Still another advantage of the present invention is that it includes a method of treating fuel wood chips. There is a theoretical calorific value of energy that is obtainable by combustion of a fuel chip. However, in practice, the actual energy released is usually lower than the theoretical value. A common reason for this energy loss is the presence of moisture within the fuel chip. That is, during combustion, energy is lost by evaporating the moisture contained in the fuel chip instead of being collected and converted into other forms of energy. Thus, the present invention also includes a method of treating the wood chips by compressing them when passing though the nip of the wood chip conditioner so that the percentage of moisture therein is reduced, and the drying and combustion properties of the wood chips are improved.

DETAILED DESCRIPTION OF THE INVENTION

Figure 1:
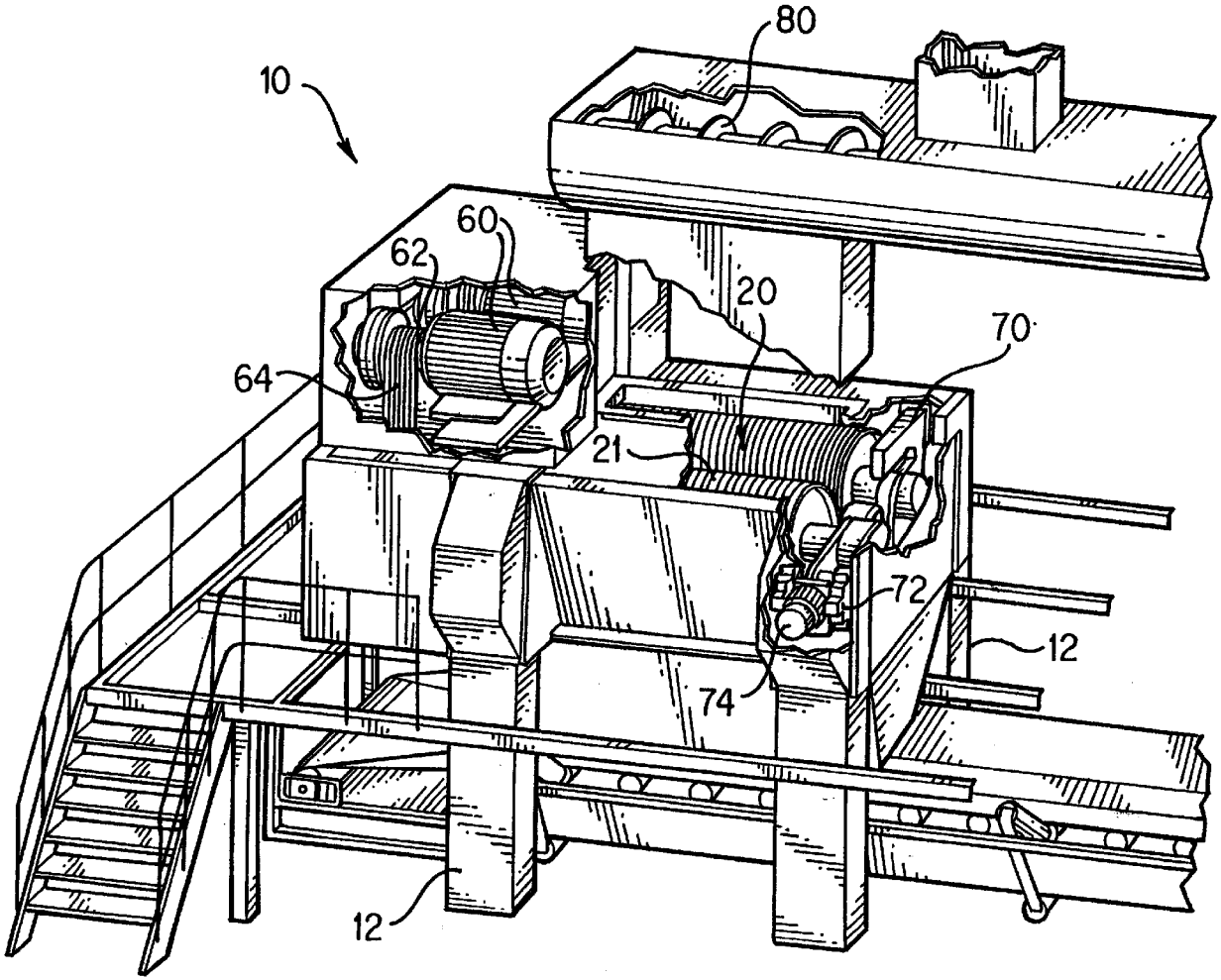
FIG. 1 is an elevated front view of the present invention in which portions thereof are cut away to show individual component parts.

The present invention is more particularly described in the following examples that are intended as illustrative only since numerous modifications and variations therein will be apparent to those skilled in the art. As used in the specification and in the claims, "a" can mean one or more, depending upon the context in which it is used.

Referring to FIGS. 1–5, the present invention comprises a wood chip conditioner 10, or a chip optimizer, for destructuring wood chips (not shown) by bending and compressing them. The wood chip conditioner 10 comprises a frame 12 upon which two rolls 20, 21 are mounted, a means for mounting the rolls 20, 21 adjacent each other on the frame 12, and a means for rotating at least one of the rolls 20. The two rolls 20, 21 are disposed adjacent to each other and define a nip 22 therebetween, which is of a size to allow a plurality of wood chips to pass individually therethrough. That is, individual wood chips pass through the nip 22 at a particular longitudinal, or axial, point and other wood chips may simultaneously pass through the nip 22 at other longitudinal positions. As one skilled in the art will also appreciate, more than two rolls 20, 21 can be used, e.g., two groups of two rolls 20, 21 in which each chip passes sequentially through the two nips 22.

Figure 2:
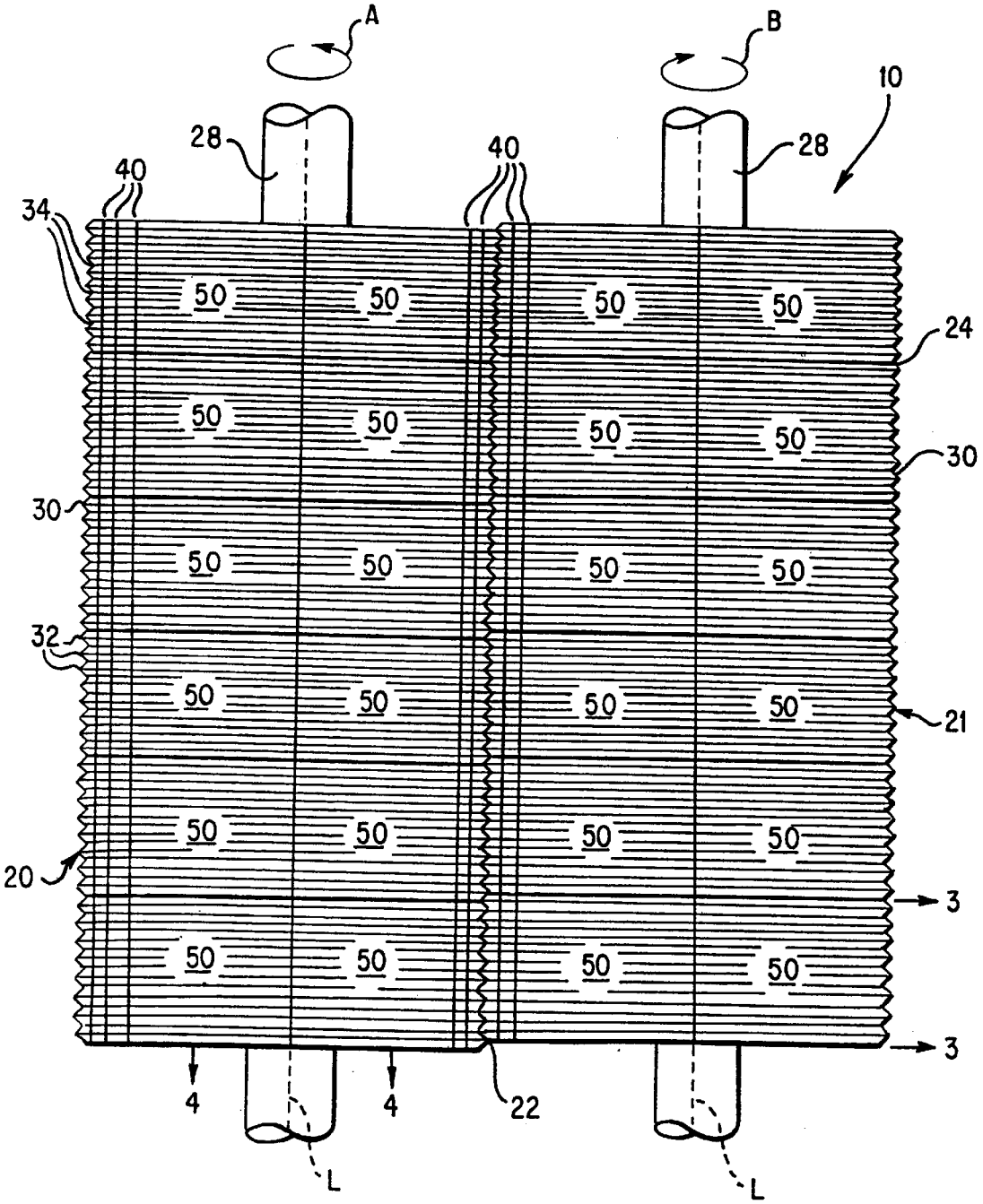
FIG. 2 is a top plan view of two rolls of the present invention.
Figure 3:
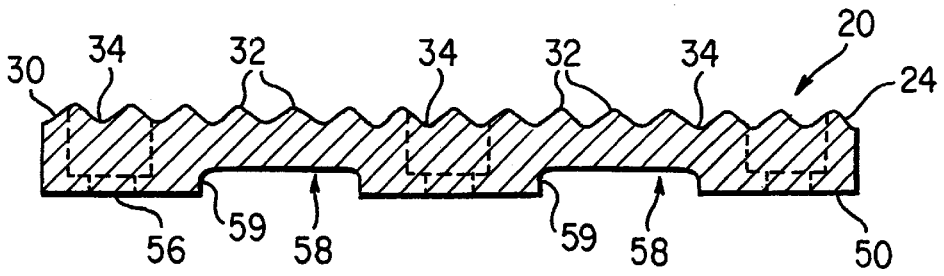
FIG. 3 is a cross-sectional side view taken along line 3—3 in FIG. 2 and showing bolts in phantom lines that hold the segments of the conditioning surface onto the inner shell of the roll.
Figure 5:
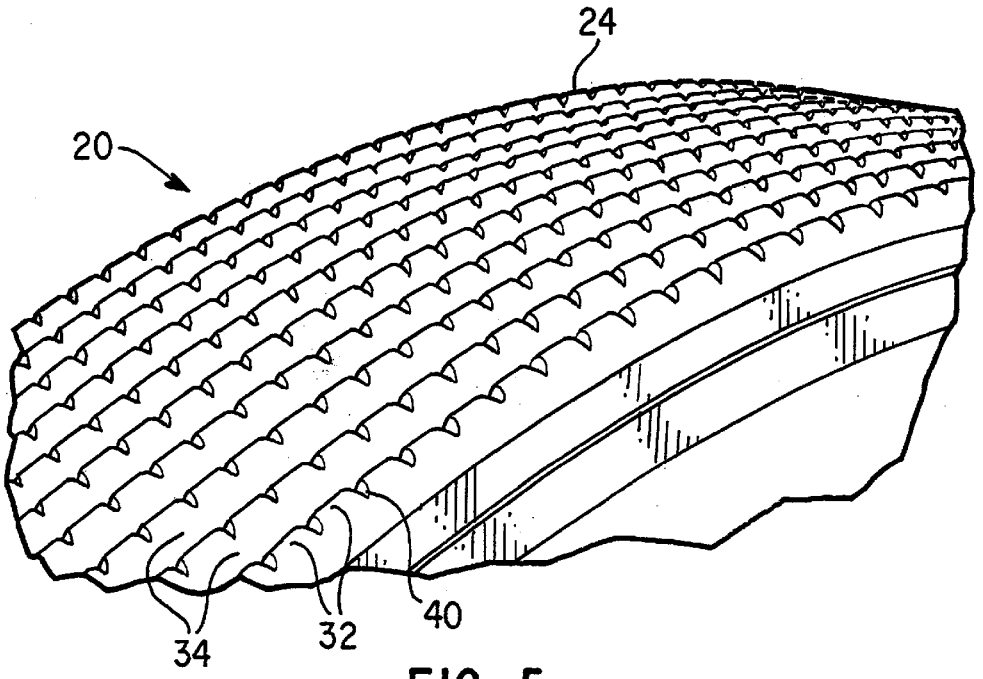
FIG. 5 is a perspective view of a portion of the conditioning surface shown in FIG. 2.
Figure 1:
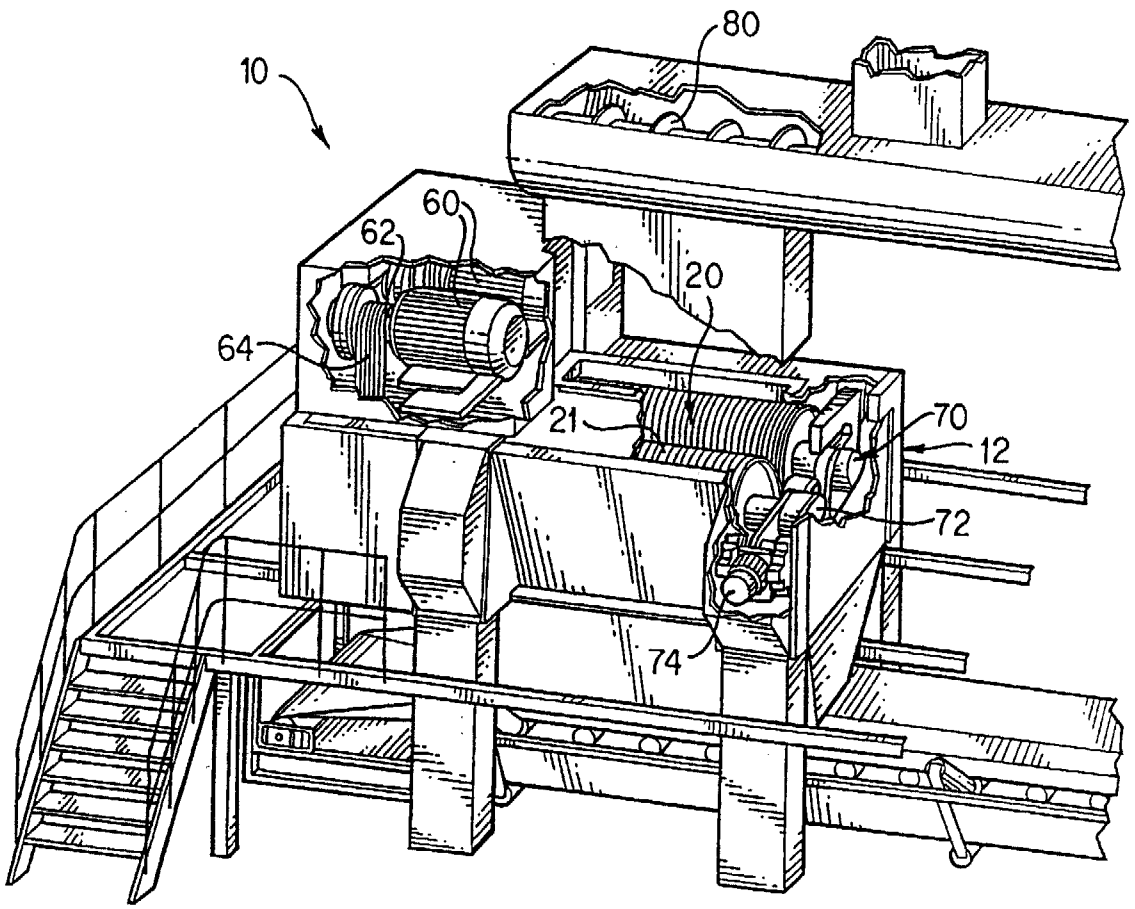

Each of the two rolls 20, 21 has an outer surface 24 and a longitudinal axis L about which the roll 20, 21 is rotatable. Specifically, the roll 20, 21 rotates about a central drive shaft 28 having a center through which the longitudinal axis L passes. The outer surface 24 of each roll 20, 21 forms a conditioning surface 30, comprising a series of sequentially alternating peaks 32 and valleys 34 radially circumscribing the roll 20, 21 to form a substantially sinusoidal pattern longitudinally extending along the roll 20, 21. This pattern is best shown in FIGS. 2, 3, and 5. Preferably, as discussed in more detail below, the regular, wave-shaped profile of the conditioning surface 30 is formed of a plurality of removable surface segments 50 mounted onto the inner shell 25 of the rolls 20, 21.

Still referring to FIG. 2, it is preferred that the conditioning surface 30 on each roll 20, 21 be the same, and that the peaks 32 on one roll 20, 21 internest between the peaks 32 of the other roll 20, 21. Thus, the peak 32 on one roll 20 is in registry with the valley 34 on the other roll 21 so that the conditioning surfaces 30 of the two rolls 20, 21 are in a peak-to-valley alignment, which is best shown in FIG. 2.

In the preferred embodiment, the portion of each peak 32 disposed farthest from the longitudinal axis L of the roll 20—or the highest point on the peak 32—is separated by seven and a half millimeters from the portion of the adjacent valley 34 disposed closest to the longitudinal axis L of that roll 20—or the lowest point in the valley 34. The preferred height of the peak 32 ranges between two and a half and ten millimeters. Each peak 32 on the conditioning surface 30 of one roll 20 is preferably longitudinally separated from a corresponding portion of the adjacent peak 32 by twenty millimeters, e.g., the peak-to-peak separation. The preferred separation range is between ten and forty millimeters. As best illustrated in FIG. 3, the peaks 32 have a radius of curvature of four millimeters and the valleys 34 also have a radius of curvature of approximately four millimeters. It is also contemplated that the radius of curvature can be larger, particularly for profiles of the conditioning surface 30 in which the peak-to-peak separation is greater than twenty millimeters. As one skilled in the art will appreciate, the dimensions may also change based on the type and dimensions of wood chips that it processes. An important consideration is to have a smooth surface that will allow the chips to bend without causing excessive fiber damage.

The desired separation between the peak 32 on one roll 20 and the valley 34 on the other roll 21, or the effective nip size, changes depending on the thickness of the chips, e.g., a smaller nip for smaller chips. The chip thickness, however, often varies, in which the chips usually have a minimum but not a maximum value. Because it is not presently practical to have a continuously variable nip responsive to the randomly sized chips, a compromise, or trial, solution can be used. That is, batches of chips are treated by the wood chip conditioner 10 having different nip values and the nip size used on the batch with the best cooking results is used for the remaining chips. As one skilled in the art will appreciate, results will vary depending on the type of chips processed, in which hardwood chips use a smaller nip size than softwood chips having the same thickness. Hardwood chips are more resistant to fiber damage and require a smaller nip size to be destructured as effectively as soft woods at a larger nip value. The nip value is most likely to be between three and six millimeters for chip destructuring and one and four millimeters for chip debarking.

As shown in FIG. 1, motors 60 rotate each roll 20, 21 in opposite directions. Referring to FIG. 2, the rotation of the two rolls 20, 21 is indicated by directional arrows A and B, in which one roll 20 is rotating toward the other roll 21. Referring back to FIG. 1, the present invention uses dual electric motors 60 that drive speed reducers 62 by matched V-belts 64. Fluid couplings (not shown) can be used at the ends of the motors 60 for soft, cushioned starts and increased motor starting torque, which mechanically protects against motor overload. The speed reducers 62 are connected to the central drive shaft 28 of the rolls 20, 21.

Wood chips are fed onto the outer surfaces 24 of the two adjacent rolls 20, 21 so that the wood chips are disposed intermediate the longitudinal axes L of the two rolls 20, 21. Because of the opposed rotation of the rolls 20, 21, the chips fed onto the rolls 20, 21 converge above the nip 22. The wood chips are then individually pulled into the nip 22 of the wood chip conditioner 10 so that each wood chip having the desired surface dimensions is destructured.

A wood chip having the desired surface dimensions has a portion of its surface that extends at least the same distance as the separation between two adjacent peaks 32 on the conditioning surface 30 of one roll 20. Such a wood chip passing through the nip 22 contacts at least a portion of one peak 32 on one roll 20 and at least a portion of one peak 32 on the other roll 21 so that the portion of the peaks 32 contacting the wood chip bend it. That is, the conditioning surface 30 causes the chips to bend and be compressed, creating internal cracks in the chip that are primarily in the direction of the wood fibers, e.g., along the grain, regardless of the orientation of the chip as it enters the nip 22.

In the preferred embodiment, each chip having the desired surface dimensions contacts, at a minimum, two peaks 32 on one roll 20 and a portion of one peak 32 on the other roll 21 and the intermeshed peaks 32, regardless of the orientation that the chip enters the nip 22. Thus, as the wood chip passes through the nip 22, at least a portion of the wood chip is compressed and bent by the interface of the conditioning surfaces 30 of the two rolls 20, 21, thereby creating internal cracks in the wood chip. These internal cracks allow the wood chip to absorb digester chemicals better. Therefore, oversized chips treated with the present invention are more desirable for making paper than their untreated counterparts. Importantly, the conditioning surface 30 does not penetrate the surface of the wood chips.

Figure 4:
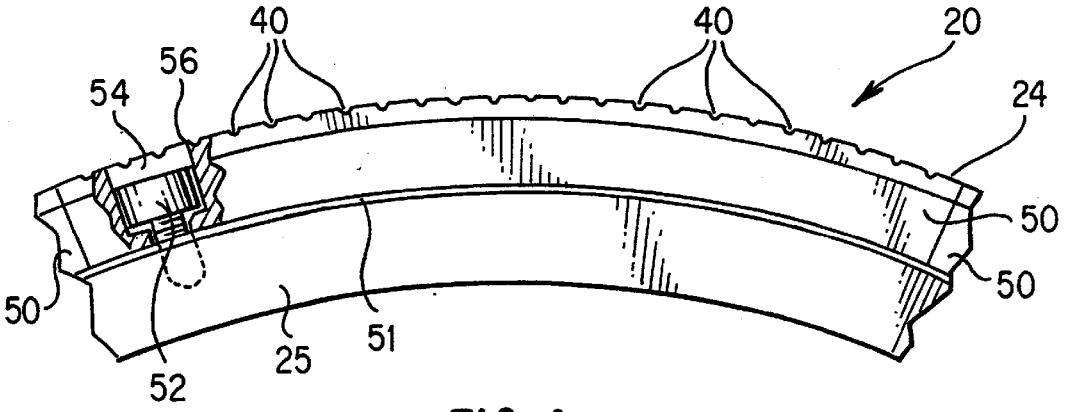
FIG. 4 is a partial end view taken along line 4—4 in FIG. 2 and showing a bolt to hold the segment of the conditioning surface.

To assist in directing the wood chips disposed on the outer surface 24 of the rolls 20, 21 into and through the nip 22, the present invention further comprises a means for pulling the wood chips. The pulling means preferably is disposed within a portion of the peaks 32 of the conditioning surface 30 on at least one roll 20 and, more preferably, on both rolls 20, 21. As shown in FIGS. 2, 4, and 5, the pulling means comprises a portion of each peak 32 on the conditioning surface 30 defining a groove 40 therein. The groove 40 is disposed substantially parallel to the longitudinal axis L of the roll 20 and, accordingly, substantially perpendicular to the radially oriented peaks 32 and valleys 34 circumscribing the roll 20. As best shown in FIGS. 4 and 5, the grooves 40 are substantially semi-circular in cross section, preferably having a two to five millimeter radius of curvature so that the grooves 40 are two to five millimeters deep. Other embodiments contemplated are grooves that are "V" shaped and square shaped in cross section. The grooves 40 preferably are spaced between ten and fifty millimeters apart. As one skilled in the art will appreciate, the smooth, rounded surfaces of the grooves 40 do not measurably increase the generation of pins and fines. Any small increase that may occur in the number of pins and fines is outweighed by the benefits of the pulling means bringing the chips into and through the nip 22.

Referring back to FIG. 1, the longitudinal axis L of one of the rolls 20, specifically the central drive shaft 28, is stationarily mounted relative to the frame 12 by bearings on a vertical member of the frame 12, which is shown as the back roll 20. This design distributes the forces through the bearing housing 70 and into the frame 12. The mounting means comprises the longitudinal axis L of the other roll 21 being movably mounted relative to the frame 12. That is, one roll 21, together with its bearings and speed reducer, is mounted on a pivoting arm assembly 72 and is laterally (or horizontally as shown in FIG. 1) adjustable by hydraulic actuators or cylinders 74. The arm assembly 72 is fixed to the lower half of the frame 12 by plain bearing pins (not shown) and pivots about a point below the rolls 20, 21. The pivot point transfers the vertical forces to the lower portion of the frame 12, where it is strongest, and allows a more simple construction, which aids in the ease of assembly and servicing.

The actuators 74 laterally move the rolls 20, 21 relative to each other in a spaced, parallel relation and, accordingly, control the size of the nip 22. The hydraulic actuators 74 also allow the rolls 20, 21 to separate in response to a foreign object such as tramp metal (not shown), which decreases the likelihood of damage to the roll surfaces. Preferably, a low-pressure hydraulic system is used because it provides increased safety, reduced potential of leakage, and quieter operation. The pivoting arm design is easier to manufacture, assemble, and service than other designs used in the art and is subject to less wear and contamination by dirt. The pivoting arm design also allows easy attachment of the speed reducer torque arm and good distribution of the resultant forces into the lower portion of the frame 12, where it is strongest.

As also shown in FIG. 1, the wood chip conditioner 10 of the present invention further comprises a means for feeding the wood chips onto the adjacent rolls 20, 21. The fed wood chips are positioned to traverse through the nip 22 as the rolls 20, 21 rotate toward to each other. The feeding means can comprise, for example, a rotating screw 80, auger, screw conveyor, chute, hopper, vibrating conveyer, and the like that ensures even longitudinal distribution of the wood chips. It is important to ensure full use of the rolls 20, 21 to prevent overloading of any one portion of the conditioning surface 30 of the rolls 20, 21.

The rolls 20, 21 are preferably constructed with an inner shell 25 that has internal reinforcing plates (not shown). The reinforcing plates are, in turn, connected to a single central drive shaft 28 which passes completely through the roll 20, 21 along its longitudinal axis L. The external surface of the inner shell 25 is machined to a radius that matches the inside radius of the profiled segments 50. Circumferential projections (not shown), typically fifty millimeters wide, are formed on the shell surface to aid in the correct positioning of the profiled segments 50. As shown in FIG. 3, recessed area 58 is formed on the underside of the segments 50. The circumferential projections are received in the recessed area 58, which align the segments 50 on the roll 20. The recessed area 58 has a machined edge 59 that engages a respective circumferential projection to ensure that the segment profile is properly aligned perpendicular to the longitudinal axis L of the roll 20. There is one complete circumferential projection for every band of segments 50. The inner shell 25, reinforcing plates and central drive shaft 28, make up a central shaft assembly to which the surface segments 50 are fitted to make the complete roll 20.

The present invention is preferably used with an air density separator (not shown), electric magnets (not shown), or other devices to remove tramp metal from the wood chips prior to being processed through the nip 22. However, in the event tramp metal, particularly iron, is fed through the nip 22, the hydraulic actuators 74, responding to the greater load between the rolls 20, 21, are designed to allow the rolls 20, 21 to separate, thereby passing the offending metal through the rolls 20, 21. To minimize any damage that may still occur, the outersurface of the roll 20, 21 is formed in individual segments 50.

In the presently preferred design, eight surface segments 50 encircle the circumference of a roll 20, 21, which has a diameter of 820 millimeters. The presently preferred roll 20 is 1815 millimeters long and contains six sets of adjacent, longitudinally extending surface segments 50, for a total of 48 individual surface segments 50. Each set of surface segments 50 is longitudinally spaced apart from the adjacent set by approximately three millimeters. Two other designs presently contemplated are a roll 1209 millimeters in length having 32 segments and a roll 2421 millimeters in length having 64 segments. Each segment 50 is detachably connected to the central shaft, preferably by six recessed bolts 52 screwed into threaded-insert strengthened holes. The size of the surface segments 50 enables one person to handle each segment 50 easily.

The roll segments 50 are preferably individually cast in Kymmenite ADI with the profile in its finished form. The segments 50 can also be coated to provide a more wear resistant, or corrosion resistant, surface, if situations demand. These castings then have six countersunk fixing holes 56 machined in position before being hardened to their optimum value. The small size of the segments 50, typically one-eighth of the circumference, allows accurate manufacture and reduces the required machining to a minimum. Each segments 50 is connected to the central shaft assembly 26 by six recessed bolts 52.

One skilled in the art will also understand that, although the segments 50 are described as being cast with the surface profile complete, the surface profile could be machined into the cast segment 50. The segments 50 could also be machined from rolled plate or built-up weldments. It is also contemplated forming the conditioning surface 30 into the rolls 20, 21 instead of using segments 50.

When fitted, the heads 54 of the bolts 52 are recessed beneath the surfaces of the segments 50 to prevent interference with the inter-meshing of the conditioning surfaces 30, as shown in FIGS. 3 and 4. Although hex-socket bolts 52 are preferred, other types of bolts, removable pins, and locking mechanisms could be used.

If the tramp metal has damaged the rolls 20, the damage normally is limited to a single, or at most, a few segments 50. These segments 50 can be unbolted individually and replaced, normally by a single workman, without removing the rolls 20 from the frame 12 of the wood chip conditioner 10.

Although not preferred, a flexible or resilient material could be placed between the segments 50 and the casing. An example of this material is polyurethane.

An advantage of the present invention for treating pulp chips is that the conditioning surfaces 30 comprise smooth, continuous peaks 32 and valleys 34. In contrast, the designs of prior art devices include truncated pyramids (described in U.S. Pat. Nos. 4,953,795 and 5,385,309 as "highly aggressive contoured roll surface") and a saw-tooth series of projections. Other designs are too shallow so that there is insufficient bending to create the internal cracks. The advantage of the design of the present invention is that it creates an appropriate degree of bending, but also reduces the number of undesirable pins and fines that result from the conditioning process. As one skilled in the art will appreciate, reducing the pins and fines results in savings to the paper mill by increased yield and decreased energy consumption.

The present invention does not break the chips, as the device disclosed in U.S. Pat. Nos. 4,953,795 and 5,385,309 and assigned to Beloit Corporation, which is hereafter referred to the "Beloit chip cracking device" does. The present invention instead flexes the chips as they pass between the rolls. The bending action minimizes the wood fiber damage by producing internal cracks and fissures along the grain. The Beloit chip cracking device, in contrast, is designed to "break or fracture the chip, generally through the thickness dimension of the chip," which occurs by the surface pyramids penetrating the surface of the chip and forcing apart the fibers. The Beloit chip cracking device sometimes cuts and cracks the chips across the grain, which shortens the length of the fiber, whereas the present invention generally only internally fissures the chips along the grain. The conditioning surface of the present invention does not penetrate the chip since such penetration can cause fiber damage and increases the occurrence of pins and fines. The differences in the respective destructuring treatment of the chips used is documented in the test results.

Another important aspect of the present invention is that it can be used to release or dislodge bark from the surface of the wood to such an extent that the bark falls away or can be removed by some light physical action. This function is not an option in other prior art destructuring devices. The bending and compressing forces to which the chips are subjected as they pass through the nip 22 help loosen the bark by breaking the cambium bond between the bark and the chip. Because no penetration of the wood chip surface occurs, the bark tends to remain largely intact and can be easily identified with optical sorters (not shown) or other similar devices. The bark that is not entirely freed from the wood chip is usually loose enough to be removed by some light physical action. It is also contemplated removing the bark from the flow at a subsequent stage by an optical sorter or other mechanical device. The removal of bark from pulping chips improves the quality and yield of pulp produced and, therefore, has financial benefits not offered in prior art destructuring devices.

Additionally, debarking using the present invention produces fewer pins and fines than other prior art devices, such as grinders. Examples of prior art debarking equipment and processes are shown in U.S. Pat. No. 3,070,318 and Canadian Patent No. 839,549. Both patents disclose compressing chips between rolls, in which one roll has a smooth surface and the other has a knurled surface. However, as noted in the Canadian patent, successive crushing stages can exert too much damage to the chips, causing excessive yield losses and strength losses in the pulp product. Unlike the entirely compressive forces applied in the prior art devices, the present invention applies both bending and compressive forces. Thus, the present invention effectively breaks the bond between the bark and the chip, but causes little fiber damage.

Still another aspect of the present invention is that it includes a method of treating fuel chips so that they are dried, or combusted, more efficiently. There are several different methods of commercially using wood as a fuel. One common method is to break or cut it into small pieces, e.g., approximately fifty millimeters by fifty millimeters, and then burn the wood in a fluidized bed boiler. In this method, the wood can also be mixed with recycled or refuse-derived fuel, peat, or other combustible materials to produce the "Biofuel." This fuel has a specific calorific value and the amount of energy obtained during combustion is directly related to this value. However, during combustion, energy is also used to evaporate any moisture contained in the fuel. This moisture reduces the amount of energy that can be collected and converted into electricity. That is, the amount of recoverable energy produced during combustion is directly related to the amount of moisture present in the fuel, e.g., the lower the moisture content, the higher the percentage of the calorific value for the wood recovered.

Another method of using wood as a fuel is to turn it into a combustible gas using a process called gasification. For this process the wood chips, wood waste, and bark are commonly chopped up into pieces smaller than about thirty millimeters by thirty millimeters in size. This fuel is then dried until the moisture content is below approximately 20%, at which time it is acceptable for the gasification process. One drying method currently used is to pass the wood directly through hot flue gases, which evaporate the moisture from the wood. The rate of evaporation of moisture from the wood is directly related to the surface area of the chip that is open to, or in contact with, the drying medium. Therefore, the amount of time or energy needed to dry a chip to a desired moisture content level is affected by the surface area and volume of the chip, as well as its initial moisture content level. The time available for drying, i.e., the amount of time that a chip is subjected to drying conditions, is usually limited and, therefore, the amount of energy that can be supplied to a chip is limited. Therefore, the size of the wood chips must be such that the required moisture content level can be reached in that time with the energy available.

After being dried, the wood is effectively burnt during the gasification process under controlled conditions. Some by-products of the burning process are combustible gases, which are then burnt to produce useable energy. Therefore, in this method, the amount of moisture present in the wood is directly related to the overall efficiency of the gasification process.

In both of these processes, the initial moisture content of the wood may be as high as 60%, i.e., the weight of the wet chip is made up of 60% moisture and 40% dry fibers. Using the present invention to destructure the wood fuel chips effectively increases the surface area of the chips which is open to the drying or combustion medium. This will allow the drying or combustion to occur more quickly than with a chip that has not been destructured. Furthermore, the process of destructuring also removes some of the moisture content present in the chip, further reducing the amount of energy needed to dry or bum the chip. As one can appreciate, in a continuous process such as power generation, even a small amount of moisture removal can equate to a substantial cost savings when thousands of tons of fuel are processed every week.

The maximum amount of destructuring can be achieved by adjusting the operating variables of the device, such as nip, surface profile and roll rotation speed. Such conditions could be detrimental to the wood fibers and pulp quality if used with wood pulp chips. However, for wood being used as fuel, there are no limitations or considerations regarding fiber damage, pins and fines production, or the moisture content being similar to normal accept pulp chips. The pins and fines can in fact be advantageous as they will dry or burn more easily than larger wood pieces. Therefore, as one skilled in the art will appreciate, the profile of the outer surface of the rolls is not as important as in the destructuring and debarking processes. It is important, however, for the profile to produce the most effective results, i.e., moisture removal and flow rate through the nip.

EXAMPLES

Western Laboratories Inc., of Rauma, Finland, conducted independent laboratory pulping studies on three samples of softwood chips to determine the effect of oversized chip fraction treatment on kraft cooking and pulp properties. All samples came from an operational pulp manufacturing plant taken at the same time from the same batch of wood. Sample 1 included accept size chips, and samples 2 and 3 contained oversized chip samples. Oversized chip sample 2 was treated with the Beloit chip cracking device. Oversized chip sample 3 was treated by passing the chips through a prototype of the present invention.

The lab scale kraft cooks were designed to simulate the pulping of unbleached paper grades, like sack, kraft and release papers, and were carried out with a forced circulation digester. The quantity of rejects in the pulp was determined by screening the washed pulp through a 0.25 millimeter slot screen. The material remaining on the screen was considered to be reject, which has been calculated as percentage on wood in Table 1 below.

TABLE 1

| Sample | Temp. (C.)/ H-factor | AA (% $Na_2O$) | Resid. Alkali (gEA/1 NaOH) | Kappa No. | % Yield Total/ Scr./Rej. | Viscosity (ml/g) | Brightness (%) |
|---|---|---|---|---|---|---|---|
| 1 | 170/800 | 16.0 | 5.0 | 42.8 | 51.0/49.7/1.3 | 1,331 | 24.0 |
| 2 | 170/900 | 16.0 | 5.7 | 40.3 | 47.6/44.4/3.2 | 1,223 | 25.6 |
| 3 | 170/900 | 16.0 | 6.0 | 40.4 | 48.5/46.3/2.2 | 1,249 | 25.6 |

The results show that the cooking characteristics of all three samples are the same. The kappa number, which describes the degree of lignin removal from the wood, is the same for both of the oversized chip samples. The kappa number would also have been the same for the accept chip sample if it had been cooked with exactly the same cooking conditions as the other two samples. Both oversized chip treatment methods are, therefore, effective to bring the cooking rate to the same level as the accept chips.

There were, however, differences in the yield ("Total") and reject content ("Rej.") of each sample. Sample 3, which was treated with the present invention, produced a one percent higher yield and corresponding lower reject content than sample 2, treated by the Beloit chip cracking device. The difference in screened yield ("Scr.") was two percent higher for the present invention. This strongly evidences a better cooking homogeneity in the scale of a single chip. As one skilled in the art would expect, the screened and total yield of sample 1 was much higher than samples 2 and 3, and the reject content of sample 1 was lower.

The viscosity of the pulp, which describes the degree of polymerization of the carbohydrate macromolecules, was also slightly higher in sample 3 compared with sample 2. Although the difference is small, it supports the observation that the more homogeneous chip scale cooking exists. Again, as one skilled in the art would expect, the viscosity of sample 1 was higher than the oversized chip samples.

Referring now to Table 2 below, the pulps were beaten on a PFI mill, prepared to handsheets and tested for paper properties. Sample 1 was naturally the strongest and its tear index is three to four units higher than samples 2 and 3. There is also a clear difference of about one tear unit between samples 2 and 3 in favor of the chips treated with the present invention. Fiber length measurements (Kajaani FS-200) support the tear index results and show that sample 1 has a much higher average fiber length than samples 2 and 3. This difference is due primarily to the fibers present in the accept and oversized chip fractions, in which the oversize chips contain large quantities of knots and reaction wood which have shorter fibers. The treatment method has, however, had some effect, as evidenced by sample 3 having a lower average fiber length than sample 2. Despite the differences in fiber properties, the difference in fiber coarseness is probably best explained by the differences in yield, in which the lower yield produces a lower coarseness value.

TABLE 2

| Sample | Beating Revs | SR Number | Tens. Index (nm/g) | Tear Index ($mNm^2$/g) | Stretch (%) | Density kg/$m^3$ | Length Weighted Average (mm) | Coarseness (mg/m) |
|---|---|---|---|---|---|---|---|---|
| 1 | 6,000 | 44.0 | 120.2 | 10.8 | 3.1 | 793.0 | 2.20 | 0.215 |
| 2 | 6,000 | 55.0 | 107.0 | 9.6 | 3.2 | 832.0 | 1.63 | 0.195 |
| 3 | 6,000 | 53.5 | 116.6 | 9.8 | 3.6 | 829.0 | 1.77 | 0.201 |

When the beatability of the pulps was tested, sample 1 developed a particular tensile index with much less beating revolutions than samples 2 and 3, e.g., it required less beating energy. Also samples 2 and 3 develop a certain "SR" number (a measure of pulp drainability) quicker than sample 1. This indicates that the accept chip pulp uses the beating energy more in increasing the bonding capability of the fibers, while the oversized chip pulps use the beating energy more in cutting fibers and creating fines. Again, it is speculated that this is caused by the different fiber properties in the pulps, in which the fibers from the knots and reaction are less tolerable to the mechanical action in beating than the prime fibers in the accept chips. In this aspect, there is no difference from the two oversize chip samples.

Overall, the differences in pulp properties indicate that the present invention is more efficient in opening up the structure of a large chip particle compared to other devices in the prior art, specifically the Beloit chip cracking device. The reason for the improved results with the present invention is that there are either more fissures and cracks in the chips after treatment or those fissures are deeper and wider. This is primarily evidenced by the higher yield and lower reject content, as well as the slightly higher viscosity at the same kappa number level. Both destructuring treatments analyzed have the same cooking rate, which was also identical to the accept chips. Despite the efficient chip conditioning, the method of treating oversized chips with the present invention is more gentle to the fibers, as is supported by the higher average fiber length and better paper properties.

The benefits of the present invention translate into significant economic advantages. It can be assumed that the average fines generation of a slicer is 5% and the average pins generation is 10%. In comparison, the average fines generation is 1% and average pins generation is 0.5% for the present invention. Thus, a difference of 4% and 9.5% exists for the fines and pins generation, respectively, between the present invention and slicer. For a screen room infeed rate of 100 units per hour ("UPH," which is 200 cubic feet per hour) with a 15% oversize and a 5% accept chip screen carry over, the amount of pins and fines that the slicer generates compared with the present invention would be as follows:

| | | |
|---|---|---|
| Fines | 4.00% × 20 UPH = 0.8 UPH × 200 × 20 Lbs./Cub.Ft./2000 Lbs./Ton = | 1.6 TPH |
| Pins | 9.50% × 20 UPH = 1.9 UPH × 200 × 20 Lbs./Cub.Ft./2000 Lbs./Ton = | 3.8 TPH |
| TOTAL | | 5.4 TPH |

Assuming that 100% of the pins and fines are screened out and used for fuel and assuming a chip cost of $25.00/ton and a fuel cost of $13.00/ton, the annual savings with the present invention would be:

$$8400\ \text{Hours/Year}\times(\$25.00-\$13.00)\times 5.4\ \text{TPH}=\$544{,}320.00,$$

where the values are in U.S. dollars. As one skilled in the art will appreciate, using the present invention would also be economically advantageous compared with using the Beloit chip cracking device, although the savings would not be as significant.

Of note, the present invention is more expensive than a chipper. However, the cost difference is approximately a quarter of the annual savings for fiber loss as shown above. Additionally, the operation and maintenance costs of the present invention are also lower. Thus, the present invention has economic advantages over both conventional slicers and the Beloit Chip cracking device.

Although the present invention has been described with reference to specific details of certain embodiments thereof, it is not intended that such details should be regarded as limitations upon the scope of the invention except as and to the extent that they are included in the accompanying claims.

What is claimed is:

1. A wood chip conditioner, comprising:

a. two rolls, each roll having an outer surface and a longitudinal axis about which the roll is rotatable, the two rolls being disposed adjacent to each other and defining a nip therebetween, the nip being of a size to allow a plurality of wood chips to pass individually therethrough, the outer surface of each roll forming a conditioning surface, the conditioning surface comprising a series of sequentially alternating peaks and valleys radially circumscribing the roll so that a substantially sinusoidal pattern longitudinally extends along the outer surface of the roll, wherein a wood chip having desired surface dimensions passing through the nip contacts at least a portion of one peak on one roll and at least a portion of one peak on the other roll so that the portion of the peaks contacting that wood chip bend that wood chip;

b. a frame;

c. means for mounting the rolls adjacent each other on the frame; and d. means for rotating at least one of the rolls about its longitudinal axis.

2. The wood chip conditioner of claim 1, wherein a wood chip having the desired surface dimensions has a portion of its surface that extends at least the same distance as the separation between two adjacent peaks on the conditioning surface on one roll.

3. The wood chip conditioner of claim 1, further comprising means, disposed within a portion of the peaks of the conditioning surface of at least one roll, for pulling the wood chips disposed above the nip on the outer surface of one roll into and through the nip.

4. The wood chip conditioner of claim 3, wherein the pulling means comprises a portion of each peak on the conditioning surface defining a groove therein, the groove being disposed substantially parallel to the longitudinal axis of that roll and disposed substantially perpendicular to the peaks radially circumscribing the roll.

5. The wood chip conditioner of claim 4, wherein the groove is substantially semi-circular in cross section.

6. The wood chip conditioner of claim 5, wherein the radius of curvature of the groove is two millimeters.

7. The wood chip conditioner of claim 1, wherein the longitudinal axis of one of the rolls is stationarily disposed relative to the frame and wherein the mounting means comprises the longitudinal axis of the other roll being movable relative to the frame so that the rolls are laterally movable relative to each other, wherein relative lateral movement of the rolls adjusts the nip.

8. The wood chip conditioner of claim 7, wherein a plurality of hydraulic cylinders movably mount one of the rolls to the frame.

9. The wood chip conditioner of claim 1, wherein the conditioning surface on each roll is the same as the other roll and wherein the peaks on one roll intemest between the peaks of the other roll so that the peak of one roll is in registry with the valley on the other roll and so that the conditioning surfaces of the two rolls are in a peak-to-valley alignment.

10. The wood chip conditioner of claim 1, wherein the portion of each peak disposed farthest from the longitudinal axis of the roll is separated by seven and a half millimeters from the portion of the adjacent valley disposed closest to the longitudinal axis of that roll.

11. The wood chip conditioner of claim 1, wherein each peak on the conditioning surface of one roll is longitudinally separated from a corresponding portion of the adjacent peak on that roll by twenty millimeters.

12. The wood chip conditioner of claim 1, wherein each peak on the conditioning surface of one roll has a radius of curvature of four millimeters and wherein each valley on the same roll forms a radius of curvature of four millimeters.

13. The wood chip conditioner of claim 1, further comprising means for feeding a plurality of wood chips onto the adjacent rolls intermediate the respective longitudinal axes thereof so that the wood chips are disposed to traverse through the nip as the rolls rotate relative to each other.

14. A method of conditioning a plurality of wood chips comprising the steps of:

a. feeding the wood chips onto a wood chip conditioner having two rolls, each roll having an outer surface and being rotatable, the two rolls being disposed adjacent to each other and defining a nip therebetween, the outer surface of each roll forming a conditioning surface having a series of sequentially alternating peaks and valleys radially circumscribing the roll so that a substantially sinusoidal pattern longitudinally extends along the outer surface of the roll; and b. pulling the wood chips into and through the nip of the wood chip conditioner so that the wood chips pass individually therethrough, wherein a wood chip having desired surface dimensions passing through the nip contacts at least a portion of one peak on one roll and at least a portion of one peak on the other roll, wherein the portions of the conditioning surfaces contacting that wood chip bend and compress that wood chip, whereby the wood chips are destructured.

15. The method of claim 14, wherein a portion of at least one peak of the conditioning surface defines a groove therein, the groove being disposed substantially longitudinally along that roll and disposed substantially perpendicularly to the peaks radially circumscribing that roll, and wherein the pulling step comprises the step of a portion of the groove engaging at least one of the wood chips to assist pulling that wood chip into the nip.

16. A method of removing bark attached to wood chips, comprising the steps of:

a. feeding the wood chips having bark attached thereto onto a wood chip conditioner having two rolls, each roll having an outer surface and being rotatable, the two rolls being disposed adjacent to each other and defining a nip therebetween, the outer surface of each roll forming a conditioning surface having a series of sequentially alternating peaks and valleys radially circumscribing the roll so that a substantially sinusoidal pattern longitudinally extends along the outer surface of the roll; and b. pulling the wood chips having bark attached thereto into and through the nip of the wood chip conditioner so that the wood chips pass individually therethrough, wherein a wood chip having desired surface dimensions passing through the nip contacts at least a portion of one peak on one roll and at least a portion of one peak on the other roll, wherein the portions of the conditioning surfaces contacting that wood chip bend and compress that wood chip, whereby at least a portion of the bark from the wood chips is removed by the bending and compression that the wood chips experience passing through the nip.

17. The method of claim 16, wherein a portion of at least one peak of the conditioning surface defines a groove therein, the groove being disposed substantially longitudinally along that roll and disposed substantially perpendicularly to the peaks radially circumscribing that roll, and wherein the pulling step comprises the step of a portion of the groove engaging at least one of the wood chips to assist pulling that wood chip into the nip.

18. A method of treating wood chips having moisture therein to be used as fuel, comprising the steps of:

a. feeding the wood chips onto a wood chip conditioner having two rolls, each roll having an outer surface and being rotatable, the two rolls being disposed adjacent to each other and defining a nip therebetween, wherein the outer surface of each roll forms a conditioning surface having a series of sequentially alternating peaks and valleys radially circumscribing the roll so that a substantially sinusoidal pattern longitudinally extends along the outer surface of the roll; and b. pulling the wood chips into and through the nip of the wood chip conditioner so that the wood chips passing therethrough are compressed and destructured, whereby at least a portion of the moisture in the wood chips is removed therefrom.

19. The method of claim 18, wherein a portion of at least one peak of the conditioning surface defines a groove therein, the groove being disposed substantially longitudinally along that roll and disposed substantially perpendicularly to the peaks radially circumscribing that roll, and wherein the pulling step comprises the step of a portion of the groove engaging at least one of the wood chips to assist pulling that wood chip into the nip.

20. A wood chip conditioner, comprising:

a. a frame;

b. two rolls, each roll having an outer surface and a longitudinal axis about which the roll is rotatable, the two rolls being disposed adjacent to each other in the frame and defining a nip therebetween, the nip being of a size to allow a plurality of wood chips to pass individually therethrough, the outer surface of each roll forming a conditioning surface, the conditioning surface comprising a series of sequentially alternating peaks and valleys radially circumscribing the roll so that a substantially sinusoidal pattern longitudinally extends along the outer surface of the roll, wherein a wood chip having desired surface dimensions passing through the nip contacts at least a portion of one peak on one roll and at least a portion of one peak on the other roll so that the portion of the peaks contacting that wood chip bend that wood chip;

c. means, disposed within a portion of the peaks of the conditioning surface of at least one roll, for pulling the wood chips into and through the nip; and d. means for rotating at least one of the rolls about its longitudinal axis.

* * * * *

UNITED STATES PATENT AND TRADEMARK OFFICE

CERTIFICATE OF CORRECTION

PATENT NO. : 5,842,507
DATED : December 1, 1998
INVENTOR(S) : Fellman, et al

It is certified that error appears in the above-identified patent and that said Letters Patent is hereby corrected as shown below:

Column 2, line 25: delete "intemested" and substitute --internested--.
Column 10, line 24: delete "bum" and substitute --burn--.
Column 14, line 30: delete "intemest" and substitute --internest--.

Signed and Sealed this
Fourth Day of January, 2000

*Attest:*

*Attesting Officer*

*Acting Commissioner of Patents and Trademarks*

UNITED STATES PATENT AND TRADEMARK OFFICE

CERTIFICATE OF CORRECTION

PATENT : 5,842,507

DATED : December 1, 1998

INVENTOR(S) : Fellman, et al.

It is certified that error appears in the above-identified patent and that said Letters Patent is hereby corrected as shown below:

The title page, showing the illustrative figure, should be deleted and substitute therefor the attached title page.

Delete Drawing Sheet 1 of 3, containing FIG. 1, and substitute therefor Drawing Sheet 1 of 3, as shown on the attached page.

Column 1, line 49: delete "difference" and substitute --different--.
Column 4, line 27: delete "adjacent each other" and substitute --adjacent to each other--.
Column 8, line 5: delete "segments" and substitute --segment--.
Column 10, line 27: delete "savings" and substitute --saving--.

Figure 1 is replaced with the attached Figure 1.

Signed and Sealed this

Eleventh Day of April, 2000

*Attest:*

Q. TODD DICKINSON

*Attesting Officer*

*Director of Patents and Trademarks*

United States Patent [19]

Fellman et al.

[11] Patent Number: 5,842,507

[45] Date of Patent: Dec. 1, 1998

[54] WOOD CHIP OPTIMIZER

[75] Inventors: Hannu Antero Fellman, Rauma; Sean Walsh, Vantaa, both of Finland

[73] Assignee: BMH Wood Technology Oy, Rauma, Finland

[21] Appl. No.: 806,036

[22] Filed: Feb. 7, 1997

[30] Foreign Application Priority Data

Feb. 12, 1996 [FI] Finland ..... U960093

[51] Int. Cl.[6] ..... B27M 1/02; B27B 9/20

[52] U.S. Cl. ..... 144/364; 100/176; 241/24.29; 241/28; 241/235; 144/2.1

[58] Field of Search ..... 144/2.1, 329, 361, 144/362, 162.1, 174; 100/121, 176, 902; 241/24.29, 28, 159, 235

[56] References Cited

U.S. PATENT DOCUMENTS

| | | | |
|---|---|---|---|
| 3,438 | 2/1844 | Battin . | |
| 1,329,973 | 2/1920 | Jardine | 241/235 |
| 1,980,193 | 2/1934 | Finegan | 83/75 |
| 3,070,318 | 12/1962 | Blanchard | 241/14 |
| 3,387,795 | 6/1968 | Bidwell | 241/34 |
| 3,393,634 | 7/1968 | Blackford | 100/39 |
| 3,406,624 | 10/1968 | Kutchera et al. | 100/170 |
| 3,981,453 | 9/1976 | Berlyn et al. | 241/21 |
| 4,050,980 | 9/1977 | Schmidt et al. | 162/24 |
| 4,235,382 | 11/1980 | Smith | 241/28 |
| 4,616,785 | 10/1986 | Artiano | 241/26 |
| 4,718,338 | 1/1988 | Koba | 144/362 |
| 4,723,718 | 2/1988 | LaPointe | 241/235 |
| 4,790,360 | 12/1988 | Clarke et al. | 144/213 |
| 4,850,404 | 7/1989 | Koba | 144/2 R |
| 4,903,845 | 2/1990 | Artiano | 209/671 |
| 4,953,795 | 9/1990 | Bielagus | 241/159 |
| 5,161,591 | 11/1992 | Sealey et al. | 144/362 |
| 5,179,986 | 1/1993 | Beuving et al. | 144/362 |
| 5,199,476 | 4/1993 | Hoden | 144/362 |
| 5,234,040 | 8/1993 | Koba | 144/2 R |
| 5,385,309 | 1/1995 | Bielagus | 241/235 |
| 5,505,238 | 4/1996 | Fujii et al. | 144/362 |
| 5,533,684 | 7/1996 | Bielagus | 144/362 |

FOREIGN PATENT DOCUMENTS

| | | |
|---|---|---|
| 0825416 | 10/1969 | Canada . |
| 0839549 | 4/1970 | Canada . |
| 0328067 | 8/1989 | European Pat. Off. . |
| 2113572 | 5/1972 | France . |
| 2333727 | 2/1975 | Germany . |
| 1037946 | 8/1983 | U.S.S.R. . |
| 0261753 | 12/1927 | United Kingdom . |
| 0406262 | 5/1932 | United Kingdom . |

*Primary Examiner*—W. Donald Bray
*Attorney, Agent, or Firm*—Needle & Rosenberg, P.C.

[57] ABSTRACT

A wood chip conditioner that uses at least two closely spaced, counter-rotating rolls having a regular, wave shaped profile formed into their surfaces having a repeating pattern of peaks and valleys that radially circumscribes the roll and which are preferably the same dimension and offset from each other so that a peak on one roll is in registry with a valley on the other roll and form a nip through which oversized wood chips traverse. The chips passing through the nip are destructured by being bent and compressed by the surfaces on the rolls, which produces internal cracks along the grain of the wood without penetrating the chips. The rolls are also designed to avoid breaking or fracturing the chips, which would increase the occurrence of undesirable pins and fines. The surface of the peaks preferably also have shallow, equally-spaced grooves that extend axially. The grooves provide an edge that catches and pulls the chips into and through the nip. The bending action to which the chips traversing through the nip are subjected also loosens or dislodges the bark on the outer surface of the chips by breaking the bond between the bark and the chip. The present invention also includes a method of using the wood chip conditioner to destructure and remove moisture from fuel chips.

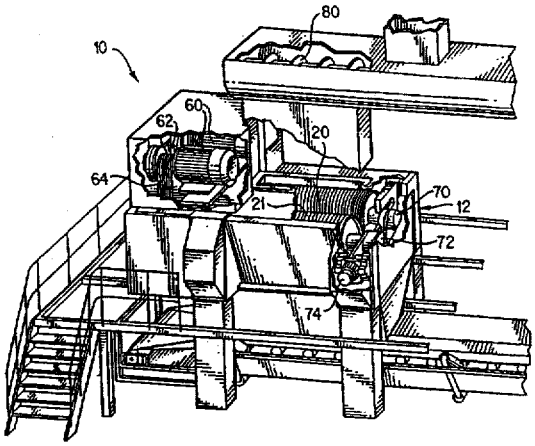

20 Claims, 3 Drawing Sheets